US006477751B2

(12) United States Patent
Baumdicker et al.

(10) Patent No.: US 6,477,751 B2
(45) **Date of Patent: *Nov. 12, 2002**

(54) SWAG TETHER AND METHOD OF SECURING THE SAME

(76) Inventors: David Baumdicker, W266 S7640 Olympia Ct. South, Waukesha, WI (US) 53189; Susan E. Baumdicker, W266 S7640 Olympia Ct. South, Waukesha, WI (US) 53189

( * ) Notice: Subject to any disclaimer, the term of this patent is extended or adjusted under 35 U.S.C. 154(b) by 0 days.

This patent is subject to a terminal disclaimer.

(21) Appl. No.: 09/917,468

(22) Filed: Jul. 28, 2001

(65) Prior Publication Data

US 2002/0029442 A1 Mar. 14, 2002

Related U.S. Application Data

(63) Continuation of application No. 09/383,873, filed on Aug. 26, 1999, now Pat. No. 6,298,526.

(51) Int. Cl.[7] ..... A44B 17/00; A47B 13/00

(52) U.S. Cl. ..... 24/559; 24/306; 24/545; 24/563; 24/716

(58) Field of Search ..... 24/559, 563, 545, 24/67.9, 306, 370, 716; 160/346; 16/87.2

(56) References Cited

U.S. PATENT DOCUMENTS

| | | | | | |
|---|---|---|---|---|---|
| 3,235,926 | A | * | 2/1966 | Mates | 24/306 |
| 3,689,957 | A | | 9/1972 | Pizzurro | |
| 4,170,181 | A | * | 10/1979 | Glasgow | 24/457 |
| 4,534,089 | A | * | 8/1985 | Swan | 24/559 |
| 4,708,183 | A | * | 11/1987 | Figueroa | 24/306 |
| 4,887,324 | A | | 12/1989 | Cairns | |
| 4,953,770 | A | * | 9/1990 | Bond, Sr. | 224/250 |
| 4,993,126 | A | * | 2/1991 | Collins | 24/563 |
| 5,060,712 | A | | 10/1991 | Ehrlich | |
| 5,109,576 | A | * | 5/1992 | Teekell et al. | 24/30.5 R |
| 5,282,616 | A | * | 2/1994 | Stacavich-Notaro | 24/306 |
| 5,287,614 | A | * | 2/1994 | Ehrlich | 29/450 |
| 5,544,393 | A | * | 8/1996 | Lightfoot | 24/306 |
| 5,639,049 | A | * | 6/1997 | Jennings et al. | 248/74.2 |
| 5,996,190 | A | * | 12/1999 | Peterson | 24/457 |

* cited by examiner

*Primary Examiner*—Victor Sakran
(74) *Attorney, Agent, or Firm*—Boyle Fredrickson Newholm Stein & Gratz S.C.

(57) ABSTRACT

A securing member or tether clip for swagging a table cloth, fabric or other similar material, has a base for gathering the table cloth to form a swag. The base includes a first end and a second end. A first arm is swingably connected to the first end of the base. A male member is connected the first arm, the male member has a neck and a head connected to the neck. A catch extends the arm. A second arm is swingably connected to the second end of the base. A female member is connected to the second arm for receiving the male member. A first hinge is connected between the first arm and the base. A second hinge is connected between the second arm and the base. A hook and loop fastener includes a first portion and a second portion. The first portion is connected to the clip. An augmenting attachment is connected to the second portion of the hook and loop fastener. The second portion connects the attachment to the first portion of the hook and loop fastener. A method of using the clip includes the steps of fastening the clip to an article such as a table cloth, gathering the article, engaging the article, inserting the male member into the female member, and attaching the attachment to the fastener.

15 Claims, 10 Drawing Sheets

SWAG TETHER AND METHOD OF SECURING THE SAME

CROSS-REFERENCE TO RELATED APPLICATION

This application is a continuation of patent application U.S. Ser. No. 09/383,873 filed Aug. 26, 1999 now U.S. Pat. No. 6,298,526 the entire contents of which are hereby incorporated by reference.

BACKGROUND OF THE INVENTION

1. Field of the Invention

The present invention relates in general to the field of fasteners. More particularly, the present invention relates to a tether or clip for fastening and securing loose articles such as a swag. Specifically, a preferred embodiment of the present invention relates to a tether clip and method for fastening, collecting, gathering, and securing draped cloth and other materials to tables, window fixtures, or other fixtures.

2. Discussion of the Related Art

In the past, one way to provide a decorative swag for a curtain, table cloth, fabric or other similar material, was to hand gather and pleat the swag one row at a time. Then while the gathered pleats were being held, one would try to pin through the several layers of fabric that have been gathered to secure them. If any of the pleats were accidentally missed, upon release those particular pleats would fall out. When using this method, one had to decide exactly where to begin collecting or gathering the fabric to create the most appealing swag or scalloped look. Thus, one would start at the bottom edge of the table linen, at a predetermined spot. Then using two hands one would manually gather fabric, determine the size of the pleats, and fold each preceding area the same way, constantly making sure that the pleats were even and still in place. Once the desired droop of the fabric and the gathered height to the table top were satisfactory, the pleated fabric would be held while the fabric was secured. If a pleat was not exactly the same as the others, it would be redone. If a securing member was not within reach, the pleating would be released and started over when a member was found.

One unsatisfactory, previously recognized approach in an attempt to solve the problem referred to herein involves the use of a stick pin. However, oftentimes it was difficult to force the straight pin or safety pin through each of the individual pleats made. After the pleats were secured, the pleating was then secured from underneath and behind into the surrounding fabric so that the pinned pleats would stay in place. Nonetheless, the pin might protrude from the pleat or be obvious to the viewer. Moreover, no further decorations were available to attach except for ribbon bow, which only adds to the amount of material which has to be secured by the pin. Further disadvantages and limitations include the fact that the past pin procedure was time consuming; required one skilled or adept at understanding the concepts of swagging; caused damage to fabrics, as well as to laborer's fingers pricked with pins and to others snagged or pricked with pins; limited the decorative options to one look; revealed unsightly pin protrusions; limited the thickness and weight of fabric available for use; limited the ability to decorate with anything other than what a straight pin may attach; required instruction and training; and was difficult to adjust swag depths without removal of pinned pleat.

Moreover, this previously recognized solution also has the disadvantage of relatively high costs, including high labor and training cost.

As decorating is a competitive business, a preferred solution will be seen by the end user as being cost effective, efficient, versatile, and providing almost unlimited swag and decorating options.

What is needed therefore is a method which does not require much, if any, training or skill; does not create perforations, indents or damage to fabric; generally does not use stick pins which protrude to injure the setup personnel or party guests; and allows for: quick setup and take down; one-hand manipulation; self-guiding as fabric is drawn up; automatic pleating; securely locking of fabric in place; inserting of greens, other accents or fabrics into pleating with ease as it is being gathered; consistency and uniformity of gather; detailed and elaborate pleating with multiple layers having fabric secured in place as the pleats are being made; customized pleating as it is being drawn up or after it has been secured; accommodation of any thickness from extremely sheer to heavy or textured fabric; generally unlimited styles of pleating and swag; adjusting swag drop to even it out or change the look without having to remove the device and repeat the entire pleating procedure again; extending of wear on fabric or linen, thus being cost effective; draping and adding of garlands and other assorted fabrics; using top edge of table, large thick ceiling swags which can be gathered with no damage to permanent fixtures and decor; suspending or hanging of items from the bottom, top or sides of the attachment clip; creating multiple layers of swags with several different fabrics and still be effective time management; creating a bordered edge around top overlap of table; securing chair ties; draping garlands, fabric, cord etc., from the bottom edge of swag; and attaching metallic, non-flexible items and larger items for decoration.

Heretofore these requirements have not been fully met without incurring various disadvantages.

SUMMARY AND OBJECTS OF THE INVENTION

By way of summary, the present invention is directed to a tether clip for securing an article. For the purposes of this disclosure, the term tether is defined as a device that holds or restrains an object or objects. The clip described herein is such a device, though other devices are known to people skilled in the art as able to perform the same functions.

One object of the present invention is to provide a method that is predictable and reproducible, thereby decreasing variance and operating costs. Another object of the invention is to provide a method that has one or more of the characteristics discussed above but which is relatively simple to set up and accomplish using relatively low-skilled workers.

In accordance with one aspect of the invention, these objects are achieved by providing a method which comprises the steps of providing a securing member that may include a base having a first end and a second end, a first arm connected to the first end of the base, a male member connected to the base, a second arm connected to the second end of the base, a female member connected to the second arm, at least one hinge connected to the base, and a fastener connected to at least one arm; fastening the securing member to the article including the steps of gathering the article within the securing member, engaging the article with the male member, and inserting the male member into the female member; and attaching an attachment to the fastener on the securing member.

In another embodiment, these objects are satisfied by providing an encapsulating securing member which may be made from rigid, semi-rigid or flexible material. Preferably, the securing member is a clip constructed and arranged to collect, draw together, gather or pleat cloth, fabric, linen or other materials, and thus, generally alter the physical contour of the original edge of the cloth, fabric, linen and/or other materials. The securing member then contains and secures the cloth, fabric or materials so that a scalloped, swagged or gathered appearance is obtained or the material collected becomes entrapped and secured.

Preferably, the member or clip is of a generally U-shaped structure that can be assembled from two rigid or semi-rigid outside arms joined by hinges or pivotal, swingable couplings along a base. The clip may also be unitarily formed of a single piece of resilient and moldable material, such as polyvinyl chloride (PVC), or fabricated with flexible detachable attachments.

Preferably, all embodiments of the securing member may be manipulated with one hand to automatically pleat the materials and to allow for freedom for adjustment and customization. An interlocking securing mechanism on the clip is at the upward top end of the front and back of the first and second arm, respectively. The mechanism incorporates a male member and compatible female receptacle member. In the open position, the securing member forms a well-defined receiving mouth for automatically aligning and regulating the collecting, gathering or pleating of the materials.

When the material has been collected, gathered or pleated between the front and back of the arms, one of the male/female members is secured, pinned, snapped or locked through an adjacent section of material and into the other male/female receiving member. This entraps the adjacent section of materials in such a way as to support the securing member and its encased material without penetrating or otherwise disturbing the integrity of material.

The encased materials are then secured and supported at desired position. When the male and female members interlock, any portion of the securing member is immediately available for receiving an attachment of any type. Such attachments may be any decorative embellishment. Alternatively, the embellishment may be incorporated by molding the embellishment as part of the securing member itself.

The securing mechanism may be released by laterally sliding or perpendicularly reversing the securing procedure locking mechanism. This also will release any entrapped or secured material.

The securing member or clip preferably is self expanding and self supporting. It may be made in any multitude of lengths, widths and depths which are most appropriate for size and thickness of material being collected. The clip may or may not have any decorative augmentation either fixed or detachable.

In another embodiment, the objects are met by providing a tether clip for a swagged table cloth comprised of a round member, a generally C-shaped member for receiving the round member, a means for holding the clip to the cloth, a means for retaining the table cloth, a fastening means attached to the clip, and a means for concealing the clip which is connected to the fastening means.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DESCRIPTION OF PREFERRED EMBODIMENTS

The present invention and the various features and advantageous details thereof are explained more fully with reference to the non-limiting embodiments described in detail in the following description.

The specific embodiments of the present invention described by the following, non-limiting examples serve to illustrate various features of significance. The examples are intended merely to facilitate an understanding of ways in which the present invention may be practiced and to further enable those of skill in the art to practice the present invention. Accordingly, the examples should not be construed as limiting the scope of the present invention. It is within the level of ordinary skill in the art after having knowledge of the invention disclosed herein to alter structure without decreasing the function of clip.

1. System Overview

Figure 3:
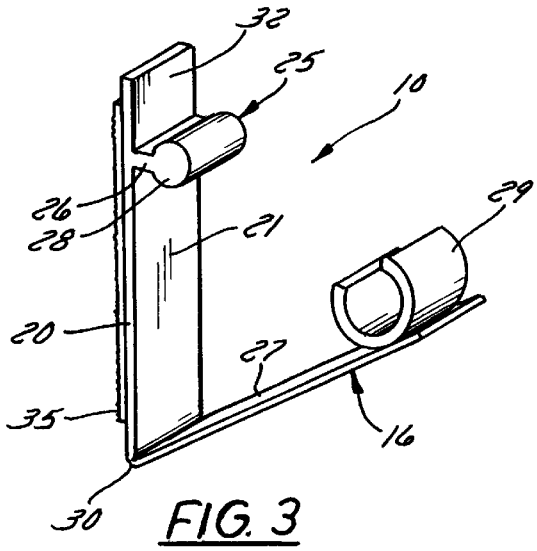
FIG. 3 is a perspective view showing another embodiment of the present invention.
Figure 4:
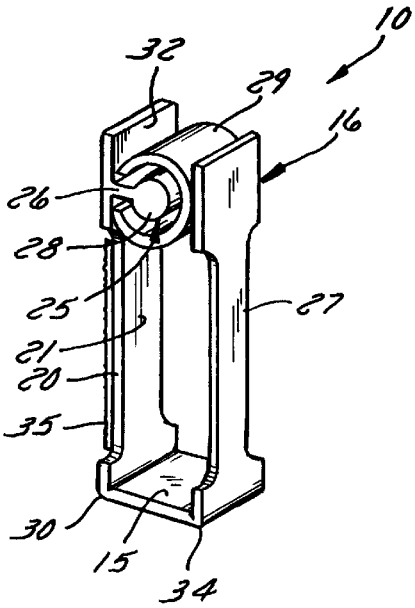
FIG. 4 is a perspective view showing another embodiment of the present invention.
Figure 5:
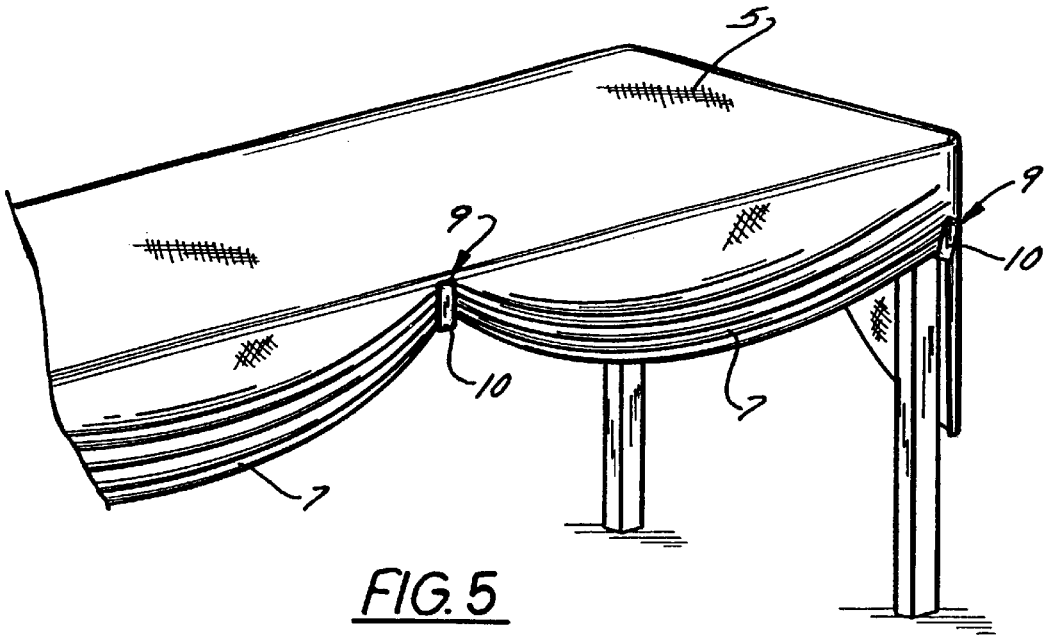
FIG. 5 is a perspective view of an embodiment of the present invention in use on a tablecloth.
Figure 6:
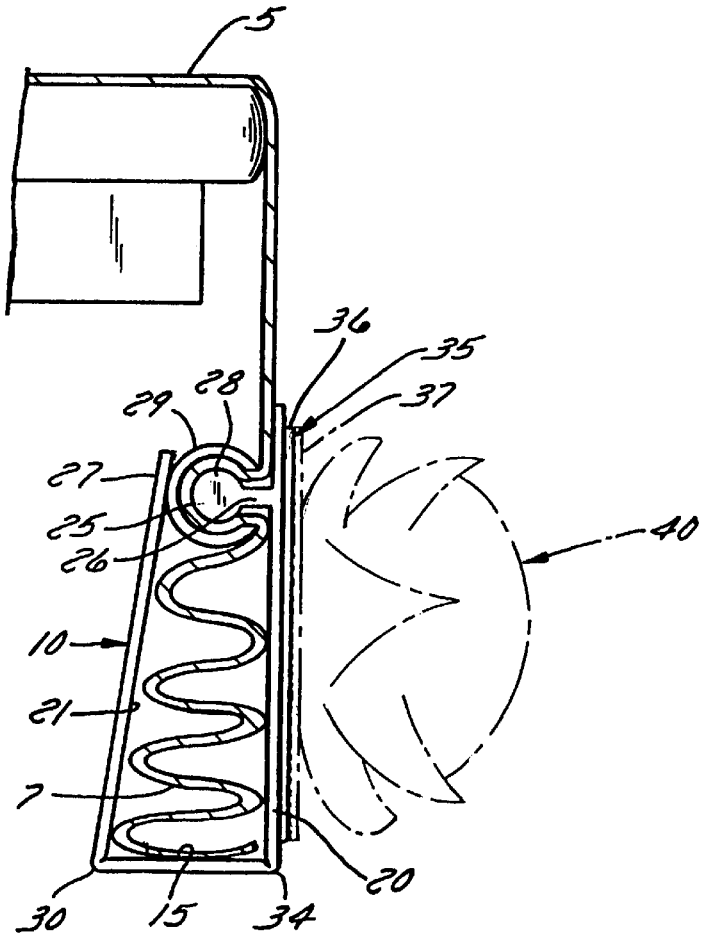
FIG. 6 is a side, cutaway view of an embodiment of the present invention in use on a tablecloth.

Referring generally to FIGS. 1–6, the present invention is a securing member 9 used for creating a swag 7 in a hanging fabric article 5 such as a tablecloth or curtain. The securing member 9 (e.g., FIGS. 17–18) can comprise a tether clip 10 as seen in FIGS. 1–16 and 20–26. The clip 10 is used to secure a swag 7 in an article 5 as shown in FIGS. 5 and 6.

Figure 1:
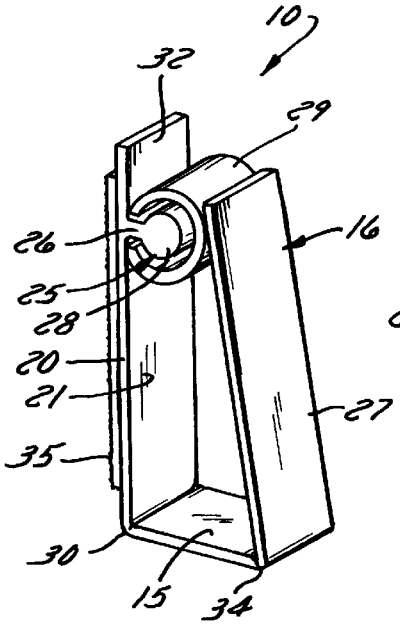
FIG. 1 is a perspective view of one embodiment of the present invention, showing the embodiment in the closed position.
Figure 2:
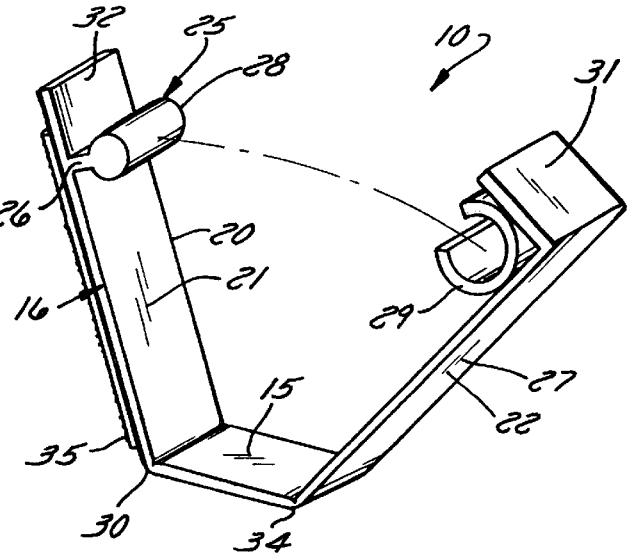
FIG. 2 is a perspective view showing another embodiment of the present invention in an open position.

Turning specifically now to FIGS. 1 and 2, the tether clip 10 generally consists of a strip of material 16, a first hinge 30, and a second hinge 34. The placement of the first hinge 30 creates a first arm portion 20 and the placement of the second hinge 34 creates a base 15 and a second arm portion 27.

The first arm 20 carries a male member 25 having a neck 26 and a head 28. The second arm 27 carries a female member 29. The female member 29 is configured and dimensioned large enough to receive both the male member 25 and the article making up the swag. Preferably, the head 28 of the male member 25 is rod-shaped and the female member 29 includes a C-shaped portion to accept the male member 25. The female member 29 may also include a neck. As shown most clearly in FIGS. 5 and 6, the article 5 is gathered to the desired height within the clip 10 and the male member 25 is snapped into the female member 29 to create a swag 7.

As shown in FIG. 1, one embodiment of the present invention provides a finger catch 32 with which to easily grasp the first arm 20 of the clip 10. In another embodiment, shown at FIG. 2, the clip 10 has a ledge 31 connected to the second arm 27 and the female member 29, providing extra durability of the clip 10.

In the embodiment shown at FIG. 3, only a first hinge 30 is employed. In this embodiment, the first hinge 30 creates both a first arm 20 and a second arm 27 without creating a base 15. This embodiment is particularly useful for creating a swag 7 in articles 5 made of thin materials, such as sheer drapes, with which the width that a base 15 provides may be counterproductive.

As shown in FIG. 4, another embodiment of the present invention is envisioned in which the arm portions 20, 27 are less noticeable. This I-shaped modification allows the arms 20, 27 to be less visible, use less fabricating material, and be lighter while still allowing the male and female members 25, 29 of the clip 10 to retain the same width and thus the same ability to secure a swag. The embodiment shown in FIG. 4 has the added advantage of creating a different tuck and drape effect in the swag when such is desired.

Figure 7:
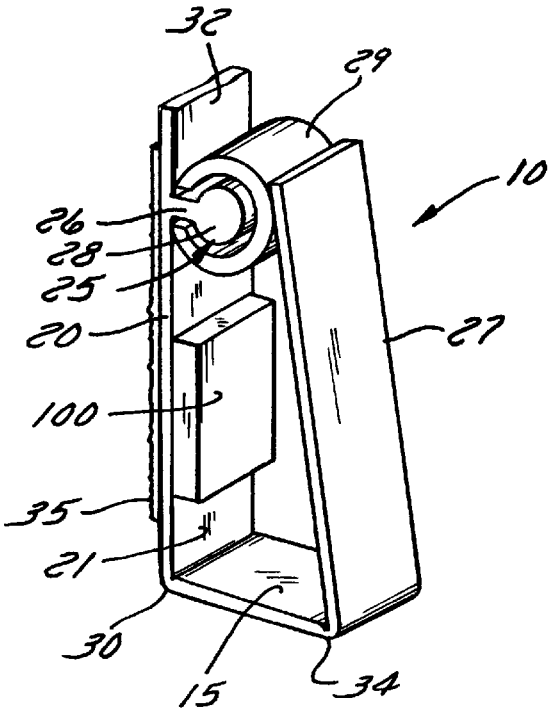
FIG. 7 is a perspective view showing another embodiment of the present invention.

Turning now to the embodiment shown at FIG. 7, it is envisioned that the clip 10 could include a friction piece 100 located on the inside surface 21 of the clip 10. The preferably square, rubber-like friction piece 100 creates friction on a swag and thus helps to hold an article placed in the clip 10 without slipping. The friction piece 100 is preferably bonded to the inside surface 21 of the clip 10 with glue.

Figure 8:
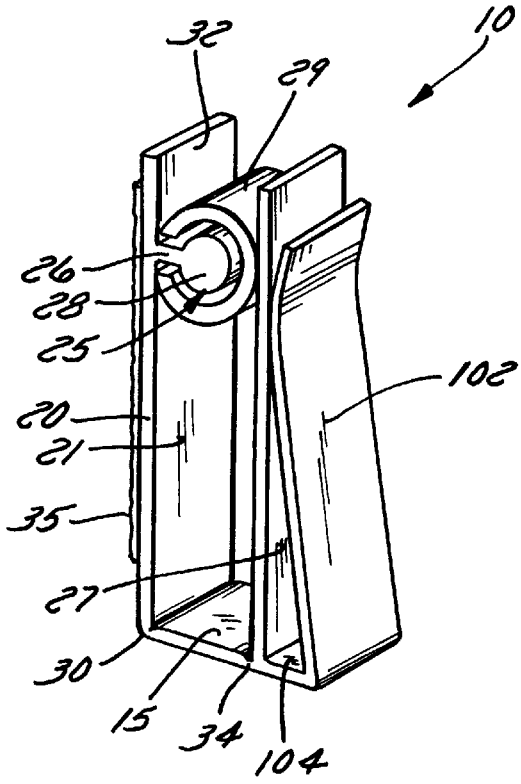
FIG. 8 is a perspective view showing another embodiment of the present invention.

Referring to FIG. 8, the tether clip 10 can also be modified to include an additional arm 102. The additional arm 102 allows additional decorative material to be placed on the swag without disturbing the swag. The additional material could include a length of ribbon, another swag of a lighter, different colored material, a string of beads, a flower chain, or other such items. A person having skill in the art will understand that the additional arm 102 can be attached to the clip 10 in a variety of ways. The additional arm 102 can have a base 104 that is glued, welded, or in another appropriate way attached to the clip 10. In addition, the base 104 of the additional arm 102 could be attached either to the base 15 of the clip 10 or to an arm 20, 27 of the clip 10.

Figure 9:
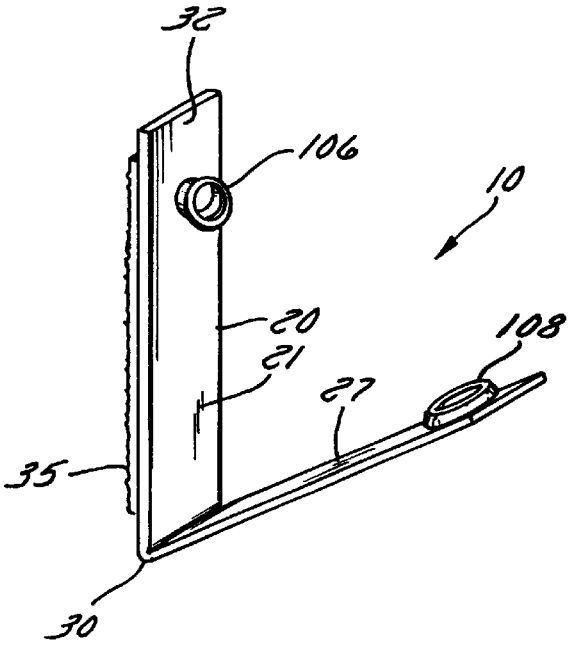
FIG. 9 is a perspective view showing another embodiment of the present invention.
Figure 10:
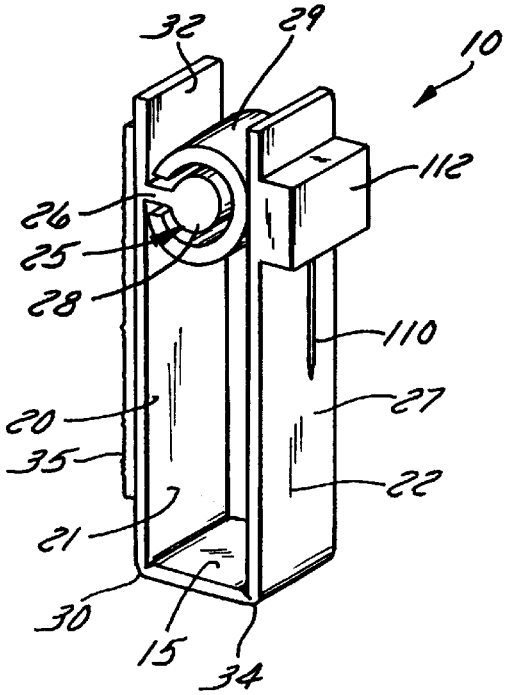
FIG. 10 is a perspective view showing another embodiment of the present invention.
Figure 11:
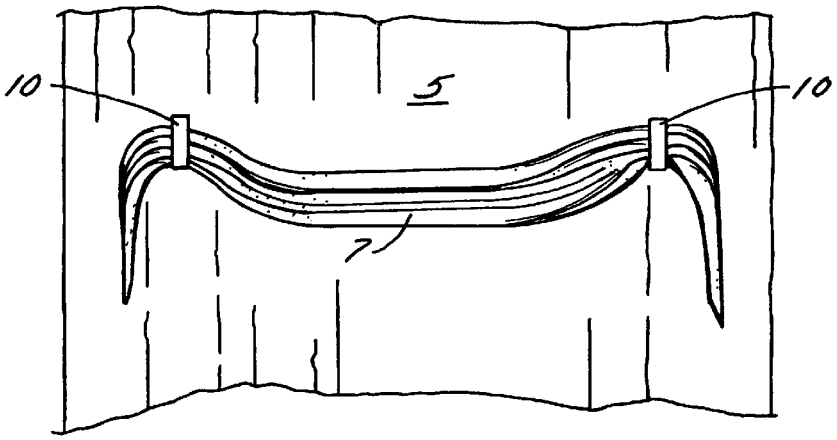
FIG. 11 is a front view of the embodiment of FIG. 10 in use.
Figure 12:
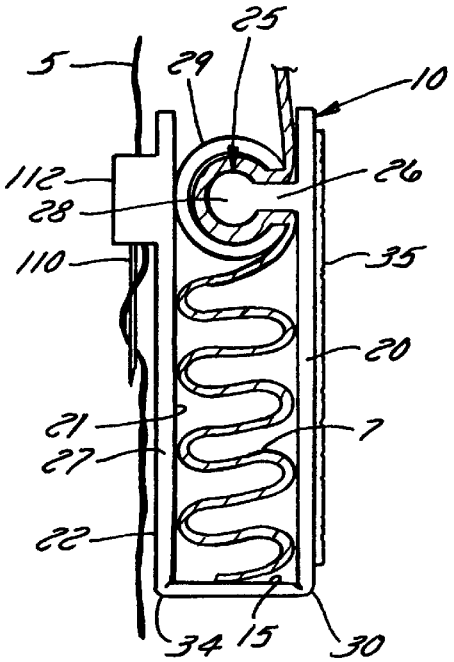
FIG. 12 is a side, cutaway view of the embodiment shown in FIG. 10 in use.
Figure 13:
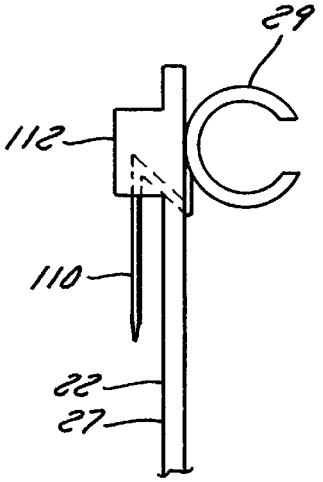
FIG. 13 is a side, cutaway view of a portion of the embodiment of FIG. 10 more clearly pointing out the shape of the pin.
Figure 14:
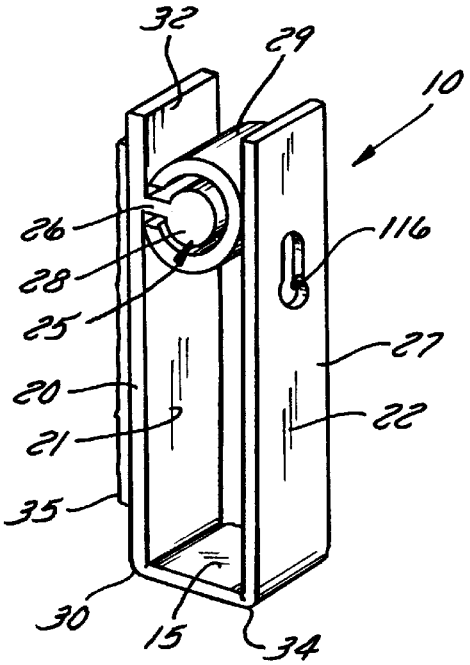
FIG. 14 is a perspective view showing another embodiment of the present invention.
Figure 15:
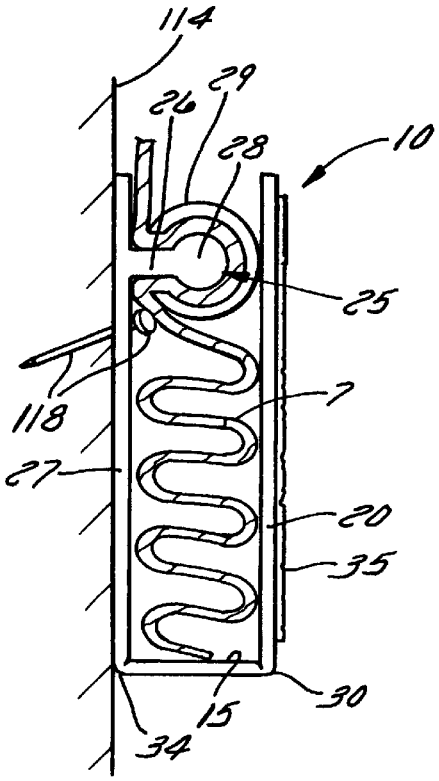
FIG. 15 is a side, cutaway view of the embodiment shown in FIG. 14.
Figure 16:
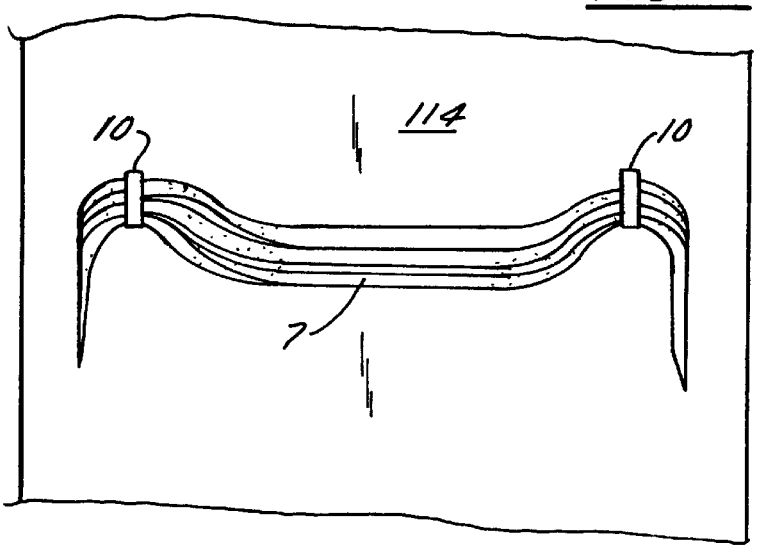
FIG. 16 is a front view of the embodiment shown in FIG. 14 in use.

Referring now to FIG. 9, another embodiment of the present invention is envisioned for articles of a thinner material. As seen previously in FIG. 3, a clip 10 having a base 15 wide enough to accommodate the thickness of a gathered fabric swag may not be desirable for a thinner material. The embodiment of FIG. 3 can be further modified to reduce the profile of the male and female members 25, 29 by replacing them with a friction connector, such as, snap head 106 and snap receptor 108 shown in FIG. 9. Alternatively, a magnetic connector may be used. This modification provides the clip 10 with all-around thinness to more efficiently and effectively retain a swag 7 in an article 5 of a thinner nature (not shown). This embodiment may be constructed of a more flexible and lightweight plastic such as polyethylene or polypropylene to further enable retention of thin articles 5 in a swag 7.

Referring now to FIGS. 10–13, it is conceivable that a decorator would desire a swag 7 across the middle of a hanging, pinnable, fabric article 5 rather than formed from the material of the article 5 itself. In this embodiment, an integral pin 110 is provided on the outside surface 22 of the clip 10. For strength when holding a heavy swag 7, the integral pin 110 of FIG. 13 can be configured in a Z-shape and can be molded within a holding base 112 on the outside surface of the clip 10. This embodiment allows a clip 10 to easily be dropped anywhere on a hanging fabric article 5 for attaching a swag 7.

In some situations, it will be desirable to place a swag 7 on a firm, non-fabric surface 114. The embodiment shown in FIGS. 14–16 allows a clip 10 to be attached to such a surface 114. The embodiment of FIGS. 14–16 comprises a keyhole 116 in one of either the first or second arms 20, 27. This allows the clip 10 to be attached to a protrusion 118 in the non-fabric surface 114. The protrusion 118 may be existing or may be placed by the decorator, and can include items such as a pushpin or a nail.

Figure 17:
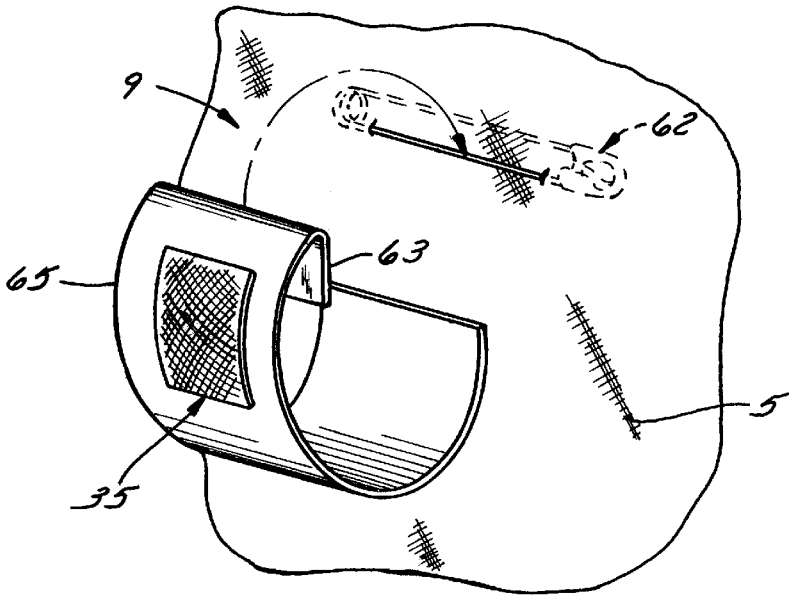
FIG. 17 is a perspective view showing another embodiment of the present invention.

In another embodiment, illustrated at FIG. 17, the securing member 9 is comprised of but not limited to a safety pin 62 and a hook 65 having a lip 63. The safety pin 62 is pinned to the hanging fabric article 5 at the desired location and the lip 63 of the hook 65 is hung over the safety pin 62. The swag 7 is created by gathering the article 5 into the hook 65.

Figure 18:
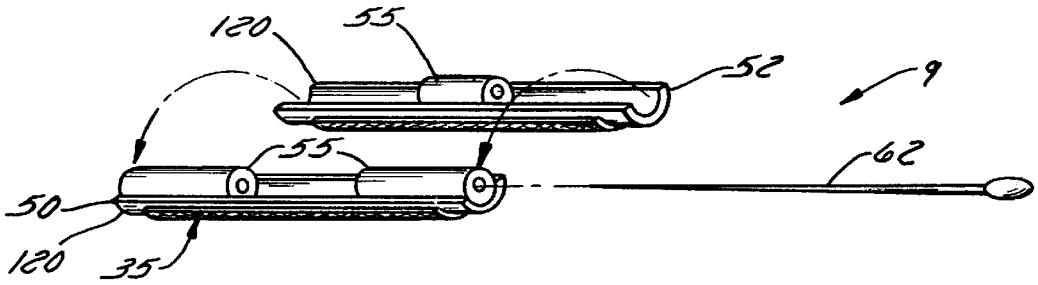
FIG. 18 is a perspective view showing another embodiment of the present invention.
Figure 19:
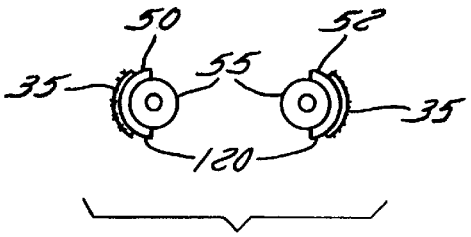
FIG. 19 is an end view of the embodiment shown in FIG. 18.
Figure 20:
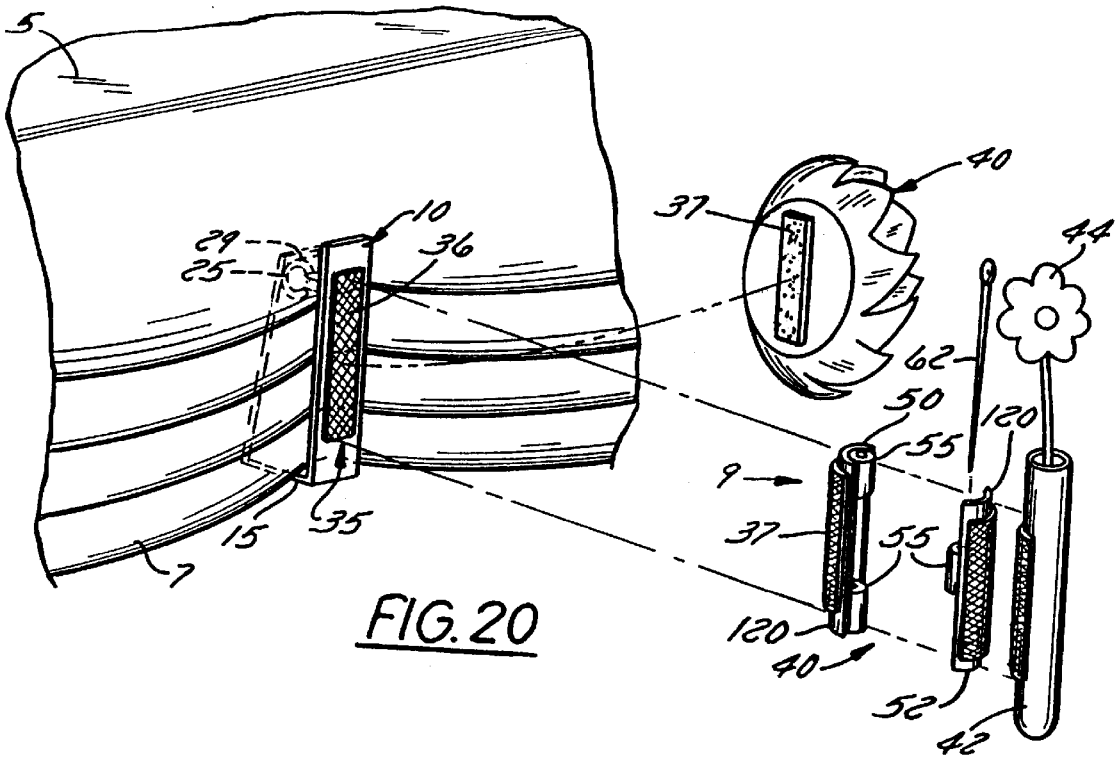
FIG. 20 is a perspective view showing the interchangeability of various embodiments of the present invention.

Referring now to FIGS. 18–20, another embodiment of the securing member 9 is envisioned. In this embodiment, the securing member 9 is comprised of at least three tubular members 55 and a hollow, split-lengthwise cylinder 120. The first and second halves 50, 52 of the cylinder 120 contain the tubular members 55. At least two of the tubular members 55 are within the first half cylinder 50 while the remaining tubular members 55 are located within the second half cylinder 52. When the first and second half cylinders 50, 52 are engaged over a hanging fabric article, a retaining pin 62 is inserted into the tubular members 55 to retain the first and second half cylinders 50, 52 over an article to create a swag. FIG. 20 shows securing member 9 in combination with clip 10.

Figure 21:
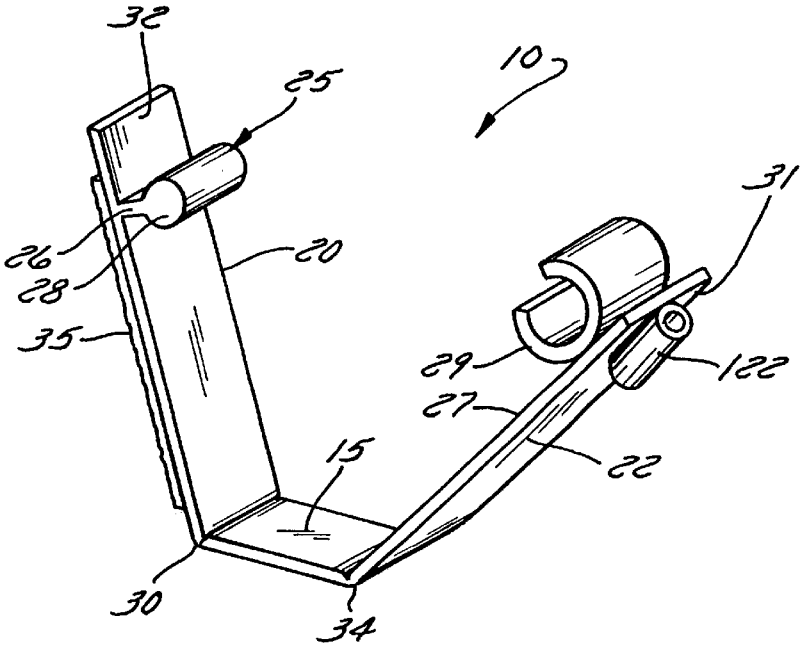
FIG. 21 is a perspective view showing another embodiment of the present invention.
Figure 22:
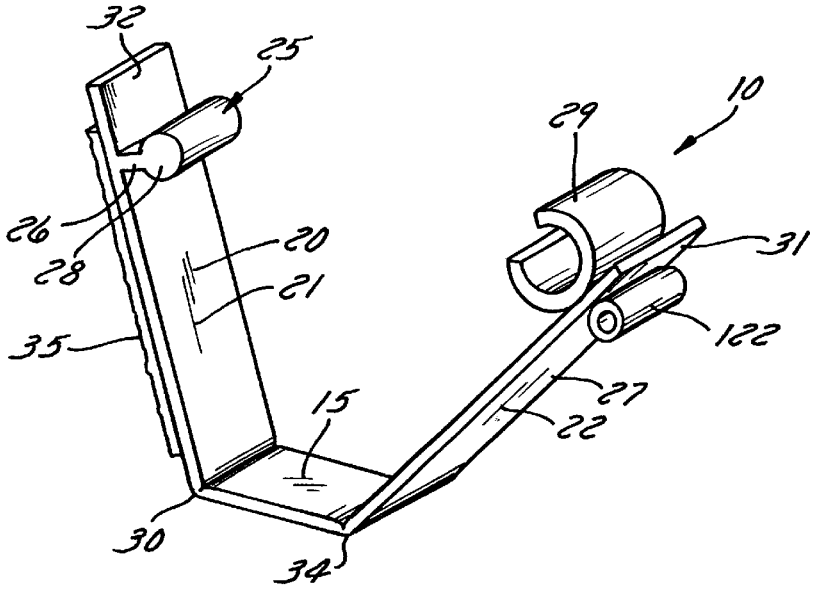
FIG. 22 is a perspective view showing another embodiment of the present invention.

Turning now to FIGS. 21–22, it is envisioned that extra parts 122 (such as a cylinder) could be glued to or molded integrally with the clip 10 to provide for placement of flower stems or other narrow decorations (not shown). These parts 122 allow for significant space savings. In FIG. 21, the member 122 is parallel to the length of the arm 27, while in FIG. 22 the member 122 is perpendicular to the length of the arm 27.

Figure 23:
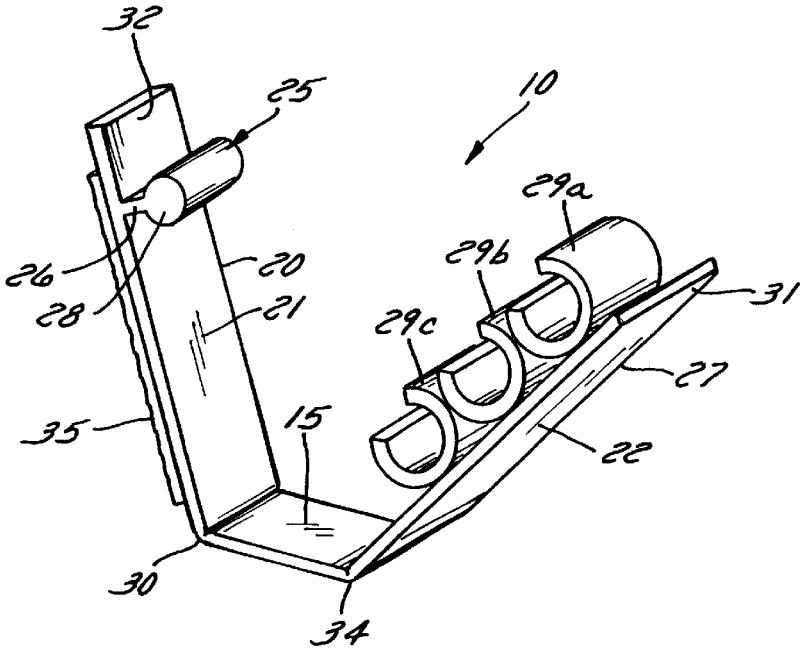
FIG. 23 is a perspective view showing another embodiment of the present invention.
Figure 24:
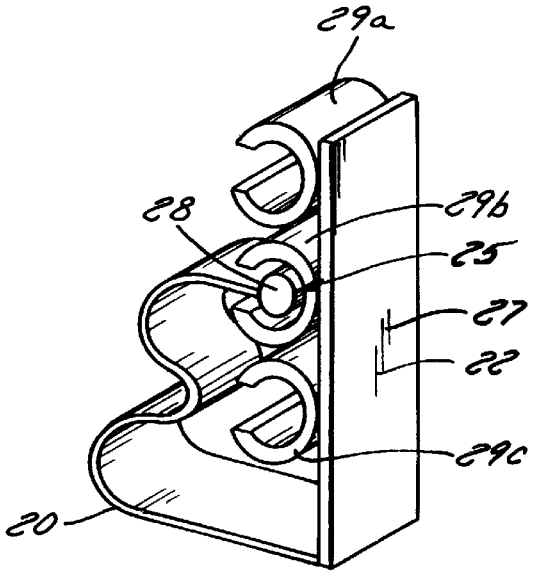
FIG. 24 is a perspective view showing another embodiment of the present invention.
Figure 25:
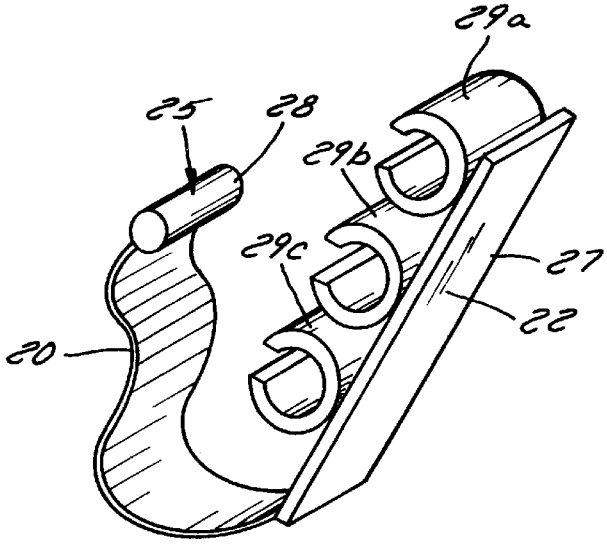
FIG. 25 is a perspective view showing another embodiment of the present invention.

The embodiment of the present invention shown in different forms in FIGS. 23–25 provides a plurality of female members 29*a–c* on the clip 10. This embodiment is useful when a variety of effects are desired in a swag 7. This embodiment also illustrates that the strip of material 16 with which the clip 10 is made need not be rigid, but rather can be made of a variety of materials such as plastic, rubber, cloth, or any appropriate combination of materials. If the strip of material 16 is a combination of generally rigid and generally flexible materials, as shown in FIGS. 24 and 25, the connection between the rigid and flexible materials would create a first hinge 30 and could be made in any manner, including gluing the flexible material to the rigid material and molding the flexible material within the rigid material. Alternatively, FIG. 23 shows an elongated base 15 to allow male member head 28 to connect with any of plurality of female members 29*a–c*. Likewise, the male member 25 in the embodiments shown in FIGS. 24 and 25 could be attached to the flexible material of the first arm 20 with glue or by molding the material of the first arm 20 within the male member 25.

Figure 26:
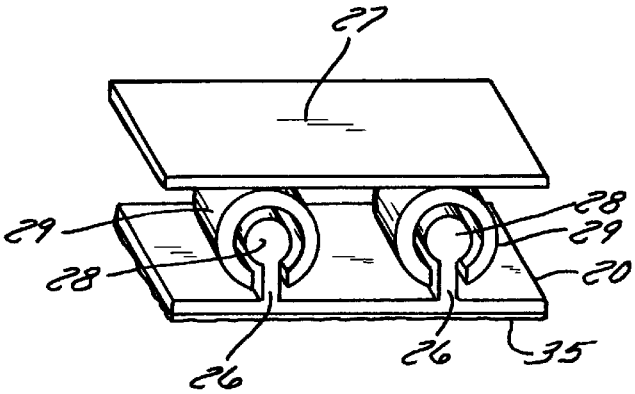
FIG. 26 is a perspective view showing yet another embodiment of the present invention.

Finally, FIG. 26 illustrates an embodiment of a clip 10 having no hinges 30, 34 or base 15. Rather, the clip 10 of this embodiment has first and second arms 20, 27 which are connected with a plurality of male members 25 and a corresponding plurality of female members 29. This embodiment has a number of advantages in that it can be placed either horizontally or vertically on a hanging fabric article 5, can be used to gather a swag 7 or other decorative or useful items, and can achieve a variety of decorative looks without hinges 30, 34 being visible.

An important feature of each of the above embodiments is that each preferably also comprises a fastener 35 with which to fasten decorative attachments 40. A person of skill in the art will recognize that the fastener 35 can be of any appropriate type, such as the hook-and-loop variety, any adhesive, pin, or any alternative material which may secure decorative attachment. As best seen in FIGS. 6 and 20, when the fastener 35 is of the hook-and-loop variety, a first fastening portion 36 will be attached to the securing member 9 and a second fastening portion 37 will be attached to the decorative attachment 40. The decorative attachments 40 can include silk or plastic flowers, ribbons, small vases for fresh flowers, buttons, etc. Another securing member could even be attached to the first fastening portion 36, as shown in FIG. 20.

In the preferred embodiment illustrated in FIG. 1, the clip 10 measures about 5 ½ inches long when fully opened. The first arm 20 is about 2 ¼ inches long from the finger catch 32 to the first hinge 30. The base 15 is preferably ½ inch long. The second arm 27 is preferably 2 inches long. The head 28 of the male member 25 preferably has a diameter of 7/32 inches. The female member 29 has an outside diameter of ½ inch and an inside diameter of ⅜ inches. The neck 26 of the male member 25 extends approximately 5/32 inches.

In the embodiment shown in FIG. 17, the safety pin or hooking device 62 measures about 2 inches long. The hook 65 has a width preferably less than 2 inches so that the lip 63 of the hook 65 can be received by the safety pin 62.

Referring to FIGS. 18–20, both the first half 50 and the second half 52 of this embodiment are about 2 inches long. The tubular members 55 connected to the halves 50, 52 have an outside diameter of roughly 7/32 inches. The retaining pin 60 is about 2 inches long.

2. In Use and Operation

When in use and operation, the securing member or clip 10 is grasped in one of a decorator's hands in an open position (see FIG. 2). An article to be secured is lifted in the other hand. The opened securing member is then placed around a first edge of the article. The clip is used to gather the article (such as a table cloth) using the gathering portion (preferably base 15, and arms 20 and 27) of the clip 10. Gathering of the cloth article occurs when the clip is moved generally upwardly toward a second edge of the cloth. (FIGS. 5 and 6). The shape of the clip allows for ease in creating swags and simultaneously pleating them, such as the one shown in FIGS. 5 and 6. Once the swag has been gathered for the right effect, the securing member is fastened or held to the cloth article by using a fastening portion. As shown in FIG. 6, the fastening portion is preferably comprised of a round male member 25 inserted into a C-shaped female member 29.

In a preferred embodiment such as the one shown in FIG. 6, the clip further includes an attachment portion which is comprised of a fastening means such as a hook and loop fastener 36. The fastening means is 36 attached or connected to the clip by preferably an adhesive. This fastener is used to attach a decoration 40 to the securing member 10. Such a decorative means serves to give the decorator a multitude of decorative options and also helps to conceal the clip.

Although the above dimensions are preferred for each embodiment shown herein, one skilled in the art will realize that the dimensions may vary widely.

The best mode contemplated by the inventors of carrying out the present invention is disclosed above, but practice of the present invention is not limited thereto. It will be manifest that various additions, modifications, and rearrangements of the features of the present invention may be made without deviating from the spirit and scope of the underlying inventive concept.

For example, the individual elements and components need not be fabricated from the disclosed materials, but could be fabricated from virtually any suitable materials of any texture, shape or color. Moreover, the securing member 9 may be extruded, molded, fabricated, assembled, pressed, welded, soldered and glued. Further, the securing member 9 may be constructed of one flexible, long-looping strip 16. Such an embodiment would utilize only a top securing mechanism, such as the male member 25—female member 29 arrangement of the clip 10.

Furthermore, the attachments 40 may be constructed of metal, rigid, flexible and/or semi-rigid plastic, tubing, rubber, fabric including ribbon, webbing, nylon, vinyl, cord, wood, cardboard, pressed board, dense paper, plexiglass, polymers, glass, mirror glass, laminate, elastic or leather. Similarly, the other elements of the securing member 9 may be constructed of similar materials.

Additionally, the elements may be molded, pressed, textured, shaped, curved, slotted with holes, opaque, semi-transparent, transparent, colored, dyed, painted, veneered, of varied lengths, stamped, imprinted, covered, slipped into another tubing, fabric or other material, or any combination thereof.

Moreover, although the securing member 9 preferably includes a round male member 25 and corresponding female member 29, generally any variation thereon is acceptable including one or more of the following: a square male and female, a round male and square female, a square male and round female, a flexible male and adjustable female, solid or hollow members, a pin or pointed insert, a ball and a socket, hooks and loops, a pivot, a spring, a clasp, a snap, a twist and lock, and a cylinder and a rod.

The various other configurations of the elements may include perforations, slits, rounded edges, curves, V-shapes, elongates, C-shapes, and S-shapes. Alternative embodiments of the hinges may include a flat hinge, more than one hinge, a flexible hinge, a rigid hinge, a thinned section of extruded plastic or the like, a molded hinge, a jointed or non-jointed hinge, and a hinge created by leaving space between the sides and covering with flexible yet durable material.

The decorations 40 may be attached to the securing member 9 at the front, bottom, back and/or top or in any combination thereof or in any of the following ways: gluing, welding, hook and loop fastener, stapling, brackets, screws, nails, part of actual mold, and any combination thereof. If detachable, the following may be used: male/female slot and notch, hooks, snaps, magnets, pins, ties, thread-throughs, tape, staples, slide and pocket, and any combination of the above.

Additional attachments 40 may include storage containers, custom decorations, line of fabrics, party favors, centerpieces, invitations, floral and green accents, theme accessories, beads, pre-measured accessories, corporate logos and trademarks, attachable hooks to hold garland or draping accessories, cylinders, a loop or ring to thread accessories through or hang accessories from, a fresh water vial, a plastic pocket or slide in front to insert items or in back for storage of small accessories, and attachments to allow the securing member to be suspended upside down. Moreover, the attachment 40 may be constructed to allow the securing member 9 to be used as the skirting clip.

The present invention need not be assembled in the disclosed configuration, but could be provided in virtually any shape, and assembled in virtually any configuration. Further, although the embodiments described herein have elements described as physically separate modules, it will be manifest that the each of the various elements may be integrated into the element with which it is associated. Furthermore, all the disclosed features of each disclosed embodiment can be combined with, or substituted for, the disclosed features of every other disclosed embodiment except where such features are mutually exclusive.

There are virtually innumerable uses for the present invention, all of which need not be detailed here. All the disclosed embodiments can be practiced without undue experimentation. For example, the present invention may be used in nearly any environment including fashion clothing, buffet lines, conference tables, guest tables and chairs, room decor, head tables, dessert tables, presentation tables, ceiling and railing draping, window or entrance displays, and showcase designs for hotels and banquet facilities, halls and wedding chapels, restaurants and off-premise catering, country clubs, conference centers and trade shows, and special events and weddings. Alternatively, the clip of the present invention may be used for safety purposes in the home, office, or clinic to: keep tubes and cords separated and easily attach labels; keep tubes separated and secured to a pillow case, sheet, or surgical table; hold the ends of the sheets in place to insure coverage of patient; hold bags, surgical towels to side of surgical table; hold a small light or items to garment or piece of cloth, etc.; attach screening around interior or exterior support rods; attach company signs, warnings and flags; and secure keys, jewelry, ID badges, arts and crafts, or other home decor.

The terms upper, lower, top, bottom and the like in the specification and claims are intended to assist the reader in understanding invention and are not intended as terms of limitation. The term "connected" is used broadly herein and includes integral with, attached, affixed, joined, adjacent, and fastened. It is not meant to imply only direct attachment but rather connection through other elements or parts. It is intended that the appended claims cover any additions, modifications and rearrangements. Expedient embodiments of the present invention are differentiated by the appended claims.

We claim:

1. A tether clip used for forming a swagged table cloth comprising:

a means for holding the clip to the table cloth comprising a generally round member and a generally C-shaped member;

a means for retaining the table cloth in a swagged configuration;

a fastening means attached to the clip; and a decorative means for concealing the clip which can be releasably connected to the fastening means.

2. A clip of claim 1 wherein the means for retaining the cloth includes at least a first arm and a second arm.

3. A clip of claim 2 wherein the first and second arms are I-shaped to reduce the visibility of the clip while in use.

4. A clip of claim 2 wherein the means for holding further comprises at one additional generally C-shaped member configured to receive the round member.

5. A clip of claim 4 wherein the second arm is constructed of a flexible material to allow the round member to connect with any of the C-shaped members.

6. A clip of claim 2 further comprising a fastener attached to the clip such that the fastener is in full view when the clip is in use.

7. A clip of claim 6 wherein the fastener comprises at least one of a hook-and-loop fastener and an adhesive material.

8. A clip of claim 2 further comprising a block connected to the first arm for retaining a pin to connect the clip to a pinnable surface.

9. A clip of claim 2 wherein at least one arm contains an opening for attaching the clip to a protrusion.

10. A clip of claim 6 further comprises a tube connected to the fastener into which various decorative materials can be inserted.

11. A clip comprising:

a strip of material having a length and a width;

at least one hinge across the width of the strip;

a first arm portion and a second arm portion attached to the hinge;

at least one male member on the second arm portion;

at least one female member located on the first arm portion for receiving the male member;

a second hinge;

a base portion created by the second hinge; and a friction piece connected to the inside of one of either the first or second arm portions, wherein said clip further comprising an additional arm connected to the clip with an additional base.

12. A clip of claim 11 further comprising a ledge connected to the female member and the first arm portion.

13. A clip of claim 11 wherein the male member is generally spherical and the female member is generally concave.

14. A clip of claim 11 wherein the male member has a cylindrical rod portion and the female member has a C-shaped portion.

15. A clip of claim 11 wherein one of either the first or second arm portions extends to form a finger catch.

* * * * *